United States Patent [19]

Dupre

[11] 4,269,526

[45] May 26, 1981

[54] PEN AND INTEGRAL CAPILLARY STORE

[75] Inventor: Georges Dupré, Crissier, Switzerland

[73] Assignee: Baumgartner Papier S.A., Switzerland

[21] Appl. No.: 34,587

[22] Filed: Apr. 30, 1979

[30] Foreign Application Priority Data

May 2, 1978 [CH] Switzerland ..... 4752/78

[51] Int. Cl.[3] ..... B43K 5/00

[52] U.S. Cl. ..... 401/198; 401/292

[58] Field of Search ..... 401/196–200, 401/292; 131/267

[56] References Cited

U.S. PATENT DOCUMENTS

| | | | |
|---|---|---|---|
| 3,094,736 | 6/1963 | Bunzl et al. | 401/198 |
| 3,111,702 | 11/1963 | Berger | 401/199 |
| 3,190,295 | 6/1965 | Tovey et al. | 131/267 |
| 3,393,684 | 7/1968 | Tovey et al. | 131/267 |
| 3,400,998 | 9/1968 | Dougherty et al. | 401/198 |
| 3,442,739 | 5/1969 | Johnson | 401/198 X |
| 3,614,245 | 10/1971 | Schwartzman | 401/196 X |
| 3,767,520 | 10/1973 | Dick et al. | 401/198 X |
| 3,778,495 | 12/1973 | Woolley | 401/292 X |
| 3,945,869 | 3/1976 | Miller et al. | 401/292 X |

FOREIGN PATENT DOCUMENTS

| | | | |
|---|---|---|---|
| 950243 | 2/1964 | United Kingdom | 401/198 |

*Primary Examiner*—Edward M. Coven

*Attorney, Agent, or Firm*—Eric P. Schellin

[57] ABSTRACT

A writing pen comprises a capillary store for storing and delivering writing liquid and a writing point connected to the store. The writing point and the store consist of the same material and form a single unit which has a stable shape at least in relation to the forces occurring during writing. The strength of the material in the store section being substantially equal to or greater than that in the writing point section.

1 Claim, 4 Drawing Figures

PEN AND INTEGRAL CAPILLARY STORE

Figure 1:
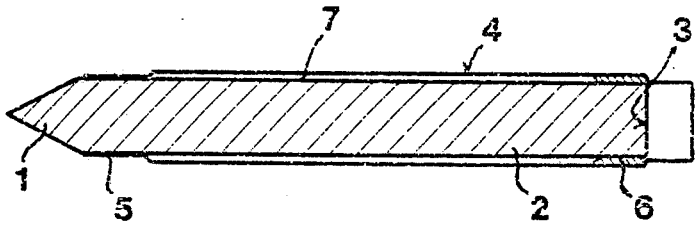

The invention relates to a writing pen, having a capillary store for storing and delivering writing liquid and a writing point connected to the store, and to a method of making such a pen.

It is known to use in fibre-tip writing pens a writing point consisting of relatively hard fibre material suitable for drawing thin lines, the writing point extending by its rearward portion into a store for the writing liquid. The store is filled with a soft wick-like filling and is constructed as an insert.

The fibre-tip writing pens of the previously mentioned known constructional form have the disadvantage that the transfer of liquid from the store to the writing point is not always perfect. Since the liquid store which is constructed as an insert is a relatively soft resilient structure, a strong writing pen casing which assumes the support function is furthermore always required, resulting in additional cost. Moreover the assembly of at least four parts (without closure cap) is very expensive. Furthermore, in consequence of the very different material structure of the fibre writing point and the liquid store connected thereto, undesirable restrictions result in the choice of the writing liquid.

According to one aspect of the invention, there is provided a writing pen comprising a capillary store for storing and delivering a writing liquid and a writing point connected to the store, the writing point and the store consisting of the same material and forming a single unit having a stable shape at least in relation to the forces occurring during writing, the strength of the material in the store being substantially equal to or greater than that in the writing point.

Because the store and the writing point consist of one piece of the same material, difficulties relating to the continuous flow of writing liquid into the writing point are substantially eliminated. A support-providing casing is unnecessary, since the liquid store which forms one piece with the writing point may be of self-supporting construction. Also the expenditure of time required for assembly may be reduced to an absolute minimum.

Preferably the material forming the writing point and the store consists of reinforced cellulose acetate which contains at least 20%, preferably at least 30%, by weight of triacetine as binder medium.

For various purposes of use, the material forming the writing point and the store may consist of polyester filaments which are welded together for the purpose of obtaining a reinforced material.

The store may be provided with an extruded covering which preferably consists of polyethylene. However it is also possible that the store be surrounded by a foil which consists preferably of polypropylene or acetate.

For obtaining a very simple and economic writing pen, the store covering preferably also forms the outside of the writing pen.

According to another aspect of the invention, there is provided a method of making a writing pen according to the invention, in which a rod section is produced having capillary properties extending in its longitudinal direction, the material of the rod section having mechanical strength properties which correspond to those of a writing point to be formed thereon, the writing point being produced by mechanical treatment of one end of the rod section.

The writing point may be produced by milling or grinding the one end of the rod section.

Preferably a rod having capillary properties extending in its longitudinal direction is produced continuously, the rod being provided with a liquid-tight covering and then being divided to form the rod sections of a desired length.

Figure 2:
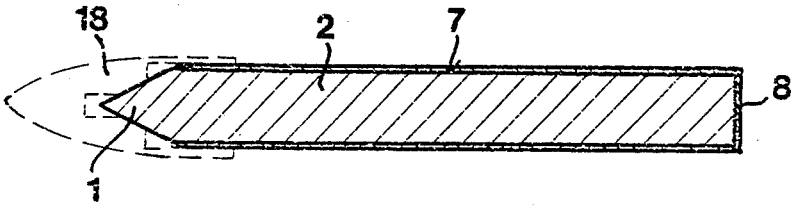
Figure 3:
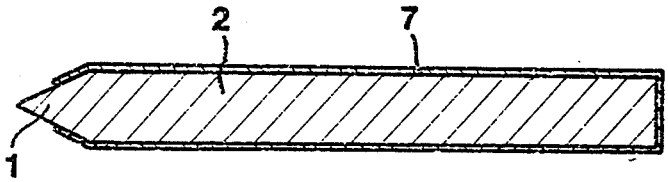
Figure 4:
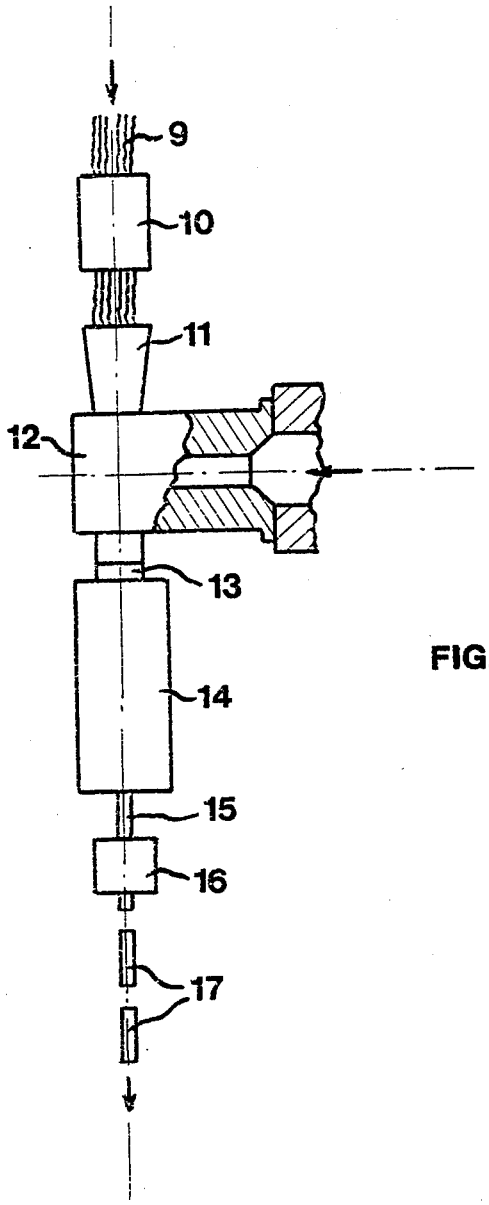

The invention will be further described, by way of example, with reference to the accompanying drawings, in which:

FIG. 1 to FIG. 3 show cross-sections of three writing pens constituting preferred embodiments of invention; and FIG. 4 shows apparatus for performing a preferred method of making rod sections.

As shown in FIG. 1, in the fibre writing pen illustrated a writing point 1 and a store 2 consist of a single strong rod section, the writing point 1 of which has been produced by milling or grinding one end of the rod section.

The mechanical strength of the rod section is so great that the chip-removing mechanical pointing thereof, for example by means of a miller or a grinding disc, does not cause any difficulties. Since, in order to obtain good writing properties, the writing point must consist of a relatively hard material, the mechanical strength properties of the remaining part of the writing point-liquid store insert 1,2 are sufficiently high in order to support the writing force acting upon the writing point 1 by way of the liquid store 2 at the rear end 3, of a writing pen casing 4.

The stable and strong rod section forming the writing point 1 and the liquid store 2 consists of cellulose acetate fibres which are fixed together by means of at least 20%, preferably at least 30%, by weight of triacetine as binder medium, and thus form a body which is of sufficiently stable shape in respect of the external forces acting upon it during assembly and during writing.

The rod sections may be produced for example by apparatus known from Swiss Patent Specification No. 367 429 and used in the production of cigarette filters, wherein the rod may be enclosed, for the purpose of liquid-tight covering, by a foil strip 7 consisting of polypropylene or acetate. In the constructional example illustrated in FIG. 1, the store 2 may alternatively be used without a covering 7.

A restricted casing front portion 5 and a clamping region 6 arranged in the rear part of the writing pen in the interior thereof serve for securely holding the liquid store 2 connected to the writing point 1 to form an insert.

When the writing pen is not in use, a closure cap may be pushed upon the front part 5 of the casing.

In the constructional form illustrated in FIG. 2, in contrast to the constructional form illustrated in FIG. 1, no special separately produced writing pen casing is used. Instead, the rod section, except for the writing point 1, is provided with a liquid-tight extruded covering 7' consisting of polyethylene and at the rear end with a likewise liquid-tight termination 8. Since the rod section 1,2 possesses a sufficiently high mechanical strength, the covering 7' may consist of a relatively thin flexible material, since it need not assume any support function.

The production of the rod sections used therefor may be effected in this case for example as shown in FIG. 4.

As shown in FIG. 7, a cellulose acetate fibre rope 9 is introduced in this case into a wetting chamber 10 and is provided therein with 30% by weight of triacetine as binder medium. The fibre rope thus wetted is then guided by means of a guide funnel 11 into the interior of an extrusion head 12 to be enclosed therein in a known manner in a tube of polyethylene, to be subsequently drawn through a calibrating plunger 13 for the purpose of accurately adjusting the outer diameter, and thereafter to be guided through a cooling unit 14 for solidifying the outer covering 7' (FIG. 2).

The covered rod 15 thus produced is thereafter supplied to a cutting device 16 and divided there into individual rod sections 17. The rod sections 17 are then pointed at the one end by means of a grinding device, and are provided with a termination 8 at the other end, as shown in FIG. 2.

As shown in FIG. 2, the closure cap 18, for covering the writing point 1 may be pushed directly upon the covering 7'.

The writing pen illustrated in FIG. 3 differs from the one illustrated in FIG. 2 substantially only in that the liquid-tight covering 7'' is produced by dipping the pointed rod section into a bath consisting of a suitable synthetic resin material, wherein in this case only the foremost tip of the writing point 1 remains outside the bath and thus is not covered by the covering 7''. In this constructional example also, a closure cap 18 in accordance with FIG. 2 may be used.

The mechanical strength and stability of shape of the rod material used must obviously be such that, after impregnation of the rod material with the writing liquid, the writing point possesses a sufficiently high strength in relation to the writing forces later on occurring during writing in order to retain the desired shape of the writing point.

It has been found very advantageous for the density of the material forming the writing point 1 and the store 2 and containing triacetine to be in the range of from 0.14 to 0.48 g/cm$^3$ (grams per cubic centimeter) and preferably in the range of from 0.19 to 0.41 g/cm$^3$.

In order to obtain a sufficiently stable writing pen, it has been found advantageous as judgment criterium for the coefficient of deformation $V=(D-a)/D\times 100$ (%) of the store section 2 to be in the range of from 95 to 99%, preferably in the range of from 96 to 98%, wherein D is the diameter of the store section 2 in mm (millimeters) and a is equal to the impression of a feeler plate having a diameter of 12 mm at a pressure of 300 grammes lasting 10 seconds into the middle portion of the store section 2. This testing method is already well known in the cigarette filter industry.

What is claimed is:

1. A writing pen comprising a capillary store for storing and delivering a writing liquid and a writing point connected to the store, the writing point and the store consisting of the same material and forming a single unit, the material forming the writing point and the store comprises cellulose acetate reinforced by at least 20% triacetine, said store being in the form of a rod with the writing point being formed at one end of said rod, the density of the triacetine reinforced material forming the writing point and the store being from 0.14 to 0.48 g/cm$^3$, and in which the material of the writing point and the store further comprises polyester filaments fused together to reinforce the material.

* * * * *